United States Patent [19]

Wolf

[11] Patent Number: 5,046,638

[45] Date of Patent: Sep. 10, 1991

[54] SEAMLESS PRESSURE VESSEL WITH RECESSED INDENTATION

[75] Inventor: Raymond D. Wolf, Chaska, Minn.

[73] Assignee: Fluoroware, Inc., Chaska, Minn.

[21] Appl. No.: 498,049

[22] Filed: Mar. 22, 1990

[51] Int. Cl.[5] ..... B65D 25/18

[52] U.S. Cl. ..... 220/679; 220/586; 220/410; 220/445

[58] Field of Search ..... 220/469, 445, 3, 678, 220/679, 680, 408, 410, 401

[56] References Cited

U.S. PATENT DOCUMENTS

| | | | |
|---|---|---|---|
| 1,961,117 | 5/1934 | Wall | 220/679 |
| 1,966,241 | 7/1934 | Furrer | 220/679 |
| 2,273,154 | 2/1942 | Stromsoe | 220/680 |
| 3,363,796 | 1/1968 | Pringle | 220/445 |
| 3,596,793 | 8/1971 | Kocher | 220/679 |
| 3,604,587 | 9/1971 | Pechacek | 220/3 |
| 3,616,958 | 11/1971 | Mitchell | 220/3 |
| 3,669,299 | 6/1972 | Jones et al. | 220/445 |
| 4,015,742 | 4/1977 | Albrecht et al. | 220/445 |
| 4,625,892 | 12/1906 | Carlin, Jr. . | |
| 4,699,294 | 10/1987 | Carlin, Jr. . | |

OTHER PUBLICATIONS

Advertisement for FLUOROCLAD Systems Linings Chemical Processing, Oct. 1989, p. 110.

Declaration of Barry Rauworth dated Jul. 2, 1990.

*Primary Examiner*—Stephen Marcus

*Assistant Examiner*—S. Castellano

*Attorney, Agent, or Firm*—Faegre & Benson

[57] ABSTRACT

An improved chemical pressure vessel for storage, shipping and pressurized dispensing of fluid chemicals is formed with a seamless fluoropolymer inner liner permanently encapsulated within a metallic overpack. To protect the liner from the heat of welding during encapsulation of the overpack around the liner, the liner is formed with recessed indentation immediately adjacent the weld area. The indentation retains a sacrificial layer of fluoropolymer to ensure that the heat of welding will not affect the liner itself. In addition, the overpack is formed with a protective flange or "puddle plate" in the area of the weld to ensure that there is adequate isolation of the weld puddle from the fluoropolymer liner. The fact that the liner is seamless and permanently encapsulated within the overpack eliminates the need for periodic disassembly of the vessel for inspection of seams for possible leakage.

20 Claims, 2 Drawing Sheets

SEAMLESS PRESSURE VESSEL WITH RECESSED INDENTATION

BACKGROUND OF THE INVENTION

1. Field of the Invention

This invention relates to an improved chemical pressure vessel for storage, shipping and pressurized dispensing of fluid chemicals. The vessel is formed with a seamless fluoropolymer inner liner permanently encapsulated within a metallic overpack. To protect the liner from the heat of weld formation during the encapsulation of the overpack around the liner, the liner is formed with a recessed indentation immediately adjacent, that is, immediately behind or interior to the weld area, and the indentation retains a sacrificial layer of fluoropolymer to ensure that the heat of the welding will not affect the liner itself. The fact that the liner is seamless and is permanently encapsulated within the overpack eliminates the need for periodic disassembly of the vessel for inspection of seams for possible leakage.

2. Description of the Related Art

Various governmental agencies regulate the handling and transportation of hazardous chemicals in order to assure optimum protection of personnel and the environment against accidental spillage or leakage. Most pressurizable chemical vessels currently available for storage, shipping and pressurized dispensing of fluid chemicals are formed of a seamed inner liner encased within an outer metallic overpack, such that periodic disassembly of the overpack is required for inspection of the structural integrity of the liner against leakage. Certain pressurizable chemical vessels have been suggested with seamless liners, but none combine the features and advantages provided by the present novel seamless pressure vessel, as will be further described herein below.

Nisshin Gulf Coast EGC Corp. of Houston, Tex. provides a fluoropolymer coated metal vessel consisting of a fabricated (i.e., welded) inner fluoropolymer liner with a flanged stainless steel shell. The method by which NGC/EGC constructs their vessels is first by fabricating the outer metal (steel or stainless steel) jacket. This outer jacket would be equipped with either a bolt-on top or a manway large enough for a person to fit through. The lining is no more than pieces of sheet or film cut to the proper dimension, then rolled or formed to the proper contour of the inside jacket surface. These individual fluoropolymer pieces are then welded together inside the vessel. This lining may or may not be adhered to the outer steel/stainless steel jacket depending on the end-use (if used in vacuum application, adhering of the liner to the jacket would be necessary). The legend "NO WELDING PERMITTED" is used on the NGC/EGC vessel to prevent the possibility of someone welding on the tank that could result in the damage of the inner liner, from the high temperature of the welding arc.

The advantages of the present novel Seamless Pressure Vessel as compared to NGC/EGC are as follows:

a. Because the lining is fabricated from sheet stock and is welded together, there exists a greater potential for leaks at the welds. The inner liner of the Seamless Pressure Vessel of the present invention is a rotationally molded one-piece liner eliminating the potential for leaks at welds. The present novel vessel liner also allows a complete and thorough inspection of the liner before it is placed in the overpack.

b. The only fusing/welding that is done on the present novel vessel is done on the outside of the overpack permitting easy inspection of these areas without having to disassemble the vessel. The NGC/EGC vessel would require the disassembly of that vessel and the inconvenience and safety hazard of requiring a person to crawl inside the vessel for inspection of the welds.

c. The present novel vessel is currently United Nations approved for shipment of regulated materials internationally. NGC/EGC does not have such approval.

d. The present vessel allows for complete drainage of chemical through the bottom port and 99.9% retrieval of contained chemical through the top discharge port.

e. Incorporated in the present vessel overpack is a place where the overpack can be cut apart if the vessel is damaged and the more expensive inner liner could be salvaged. This is the same area where the final weld is made on the stainless steel overpack that incorporates the "puddle-plate" for protection of the inner liner, as will be further described herein below.

f. The present vessel does not have threaded joints, as does the NGC/EGC vessel, which under pressure and over time could result in leaks.

Carlin, Jr. U.S. Pat. Nos. 4,625,892 and 4,699,294, describe a polyolefin lined tank in which the liner is formed by rotolining directly within the stainless steel overpack itself. Rotolining is a process by which the inner lining is sprayed on to the inside surface of the metallic vessel. This lining adheres to the steel as paint would if it were sprayed on. The liner is designed to shrink slightly away from the overpack after rotational molding, resulting in no adherence or bonding between the walls of the inner polyolefin tank and the outer metallic tank. This is intended to minimize damage to the tank through thermal expansion and contraction, the inner polyolefin tank and the outer metallic tank thus being free to expand and contract independently. In addition, it is said that the separation of the inner polyolefin tank from the outer metallic tank minimizes the potential for damage to the inner tank from any physical abuse to the outer metallic tank. The negative aspects to the rotolining as described by Carlin process are as follows:

a. Delamination due to temperature cycling or a poor bond of the lining to the steel can cause gaps between the lining and the steel overpack. This type of gap has the potential to induce stresses that could ultimately lead to failure.

b. The rotolining process does not lend itself to the use of PFA Teflon® due to the high shrink characteristics of PFA®.

c. The rotolining process, as with the fabricating process of NGC/EGC, also makes inspection of the inner lining very difficult. The lining process again must take place after construction of the overpack.

SUMMARY OF THE INVENTION

This invention provides a pressurizable vessel having an inner liner and an outer overpack for storing, transporting and pressurized dispensing of fluid chemicals. The inner liner is a separately molded seamless fluoropolymer liner permanently encapsulated within the outer overpack. The outer overpack is a metallic overpack permanently heat welded in place around the inner liner in a spaced relationship therefrom. The inner liner is further formed with recesses in the areas adjacent, that is immediately behind or interior to the welds of the outer overpack. These recesses retain a sacrificial layer or amount of fluoropolymer between the liner and overpack. This sacrificial fluoropolymer layer is designed to protect the liner from the heat of weld formation on the overpack, when the overpack is permanently welded in place around the liner. In addition these recesses provide space for the finally formed weld without deformation of the liner thereby.

The inner liner is preferably formed of a perfluoroalkoxy fluoropolymer, known as PFA Teflon®, a registered trademark of DuPont.

The outer overpack is preferably formed of stainless steel. The present vessel may be formed in a variety of sizes, of up to about 330 gallon capacity. The inner liner may be formed by a variety of molding processes, including rotational molding and blow molding.

The liner is integrally formed with fluid flow valve and fittings which extend through correspondingly sized openings in the surface of the outer overpack. Pressurizable connection of these valves and fittings on the outside of the vessel are preferably completed using a process described in commonly assigned co-pending application Ser. No. 881,968, filed July 3, 1986, by Michael Osgar, entitled WELDING FLUOROPOLYMER PIPE AND FITTINGS, the subject matter of which is incorporated herein by reference.

These and other features of the novel seamless pressure vessel of this invention will be apparent to those skilled in this art upon reading the following detailed description in reference to the accompanying drawings.

DETAILED DESCRIPTION OF THE INVENTION

Figure 2:
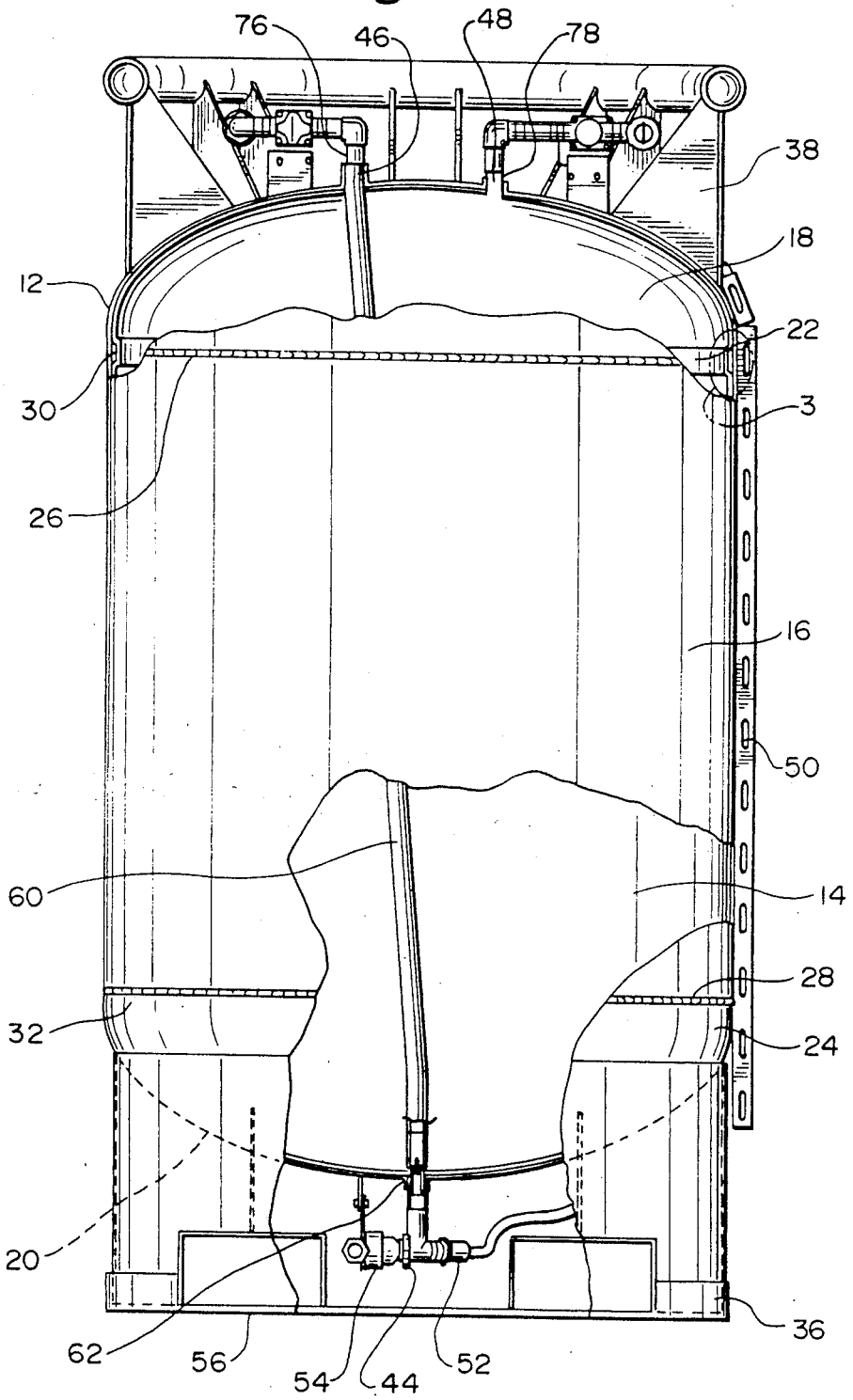
FIG. 2 is a side elevational view thereof with parts broken away, generally along line 2—2 in FIG. 1.
Figure 3:
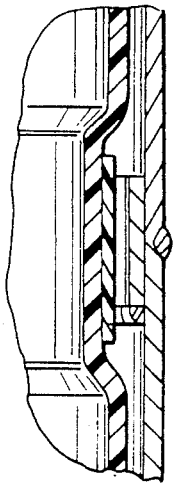
FIG. 3 is a greatly enlarged sectional detail taken from the area encircled at 3 in FIG. 2.

As shown in FIG. 2, the complete vessel assembly 10 according to this invention comprises a metallic outer overpack housing 12 permanently welded into place encapsulating the inner fluoropolymer liner 14. The inner liner 14 has been separately molded, as by blow molding or rotational molding, to closely accommodate the overall internal dimensions and contour of the overpack 12, including formation of fluid flow fitting connections 40–48 to extend through correspondingly sized openings in the surface of the outer overpack 12. In the illustrative embodiment of FIG. 2, the overpack housing 12 consists of a cylindrical central barrel portion 16 with domed portions 18, 20 completing the enclosure of the inner liner 14. Although the present novel Seamless Pressure Vessel may be formed in any particular desired shape or configuration, the cylindrical shape provides better resistance to the pressurization necessary during fluid delivery. In addition, it has been found that the domed 20 concave configuration of the bottom of the vessel assembly 10 allows for maximum utilization of the fluid chemical contents under normal pressurized delivery. As illustrated in the enlarged sectional detail of FIG. 3, the outer surface of the inner liner 14 has been formed with recessed annular indentations 22, 24 in the areas immediately adjacent, that is immediately behind or interior to the welds 26, 28 joining the cylindrical central portion 16 to the domed portions 18, 20, respectively. Prior to the heat welding of the weld joints 26, 28, the recesses 22, 24 each retain a sacrificial layer of fluoropolymer 30, 32, respectively, positioned between the liner 14 and the overpack 12, as illuatrated in FIG. 3. The purpose of this sacrificial fluoropolymer layer 30, 32 is to protect the liner 14 from the heat of the welding arc during weld formation on the overpack 12. In addition, the recesses 22, 24 provide room for expansion of the formed weld 26, 28 preventing deformation of the liner 14 thereby. The cylindrical central portion 16 of the overpack 12 is desirably formed with an interior annular alignment ring flange 34, to facilitate positioning of the domed end portions 18, 20 thereover and to provide further protection of the inner liner 14 from the heat of the weld formation. During weld formation, this annular alignment ring flange 34 acts as a protective "puddle plate" to ensure that there is adequate isolation of the weld puddle from the liner 14.

The sacrificial fluoropolymer layer 30, 32 also allows the metallic overpack 12 to be cut apart at the weld area 26, 28 if necessary for any reason, such as for example if there is damage to the metallic overpack 12, and the more expensive inner liner 14 can be salvaged and reused in a replacement metallic overpack 12 to form a new complete vessel assembly 10.

In order to provide for stable positioning of the present novel seamless pressure vessel 10, the exterior surface of the domed portion 20 may be further provided with a suitable pediment, such as the circular footed base 36 illustrated in FIG. 2. In order to provide suitable protection for the various fluid flow fittings 40, 42, 44, 46 and 48 of the vessel 10, the exterior surface of the domed portion 18 may be further provided with a circular collar 38 as illustrated in FIG. 2.

Figure 1:
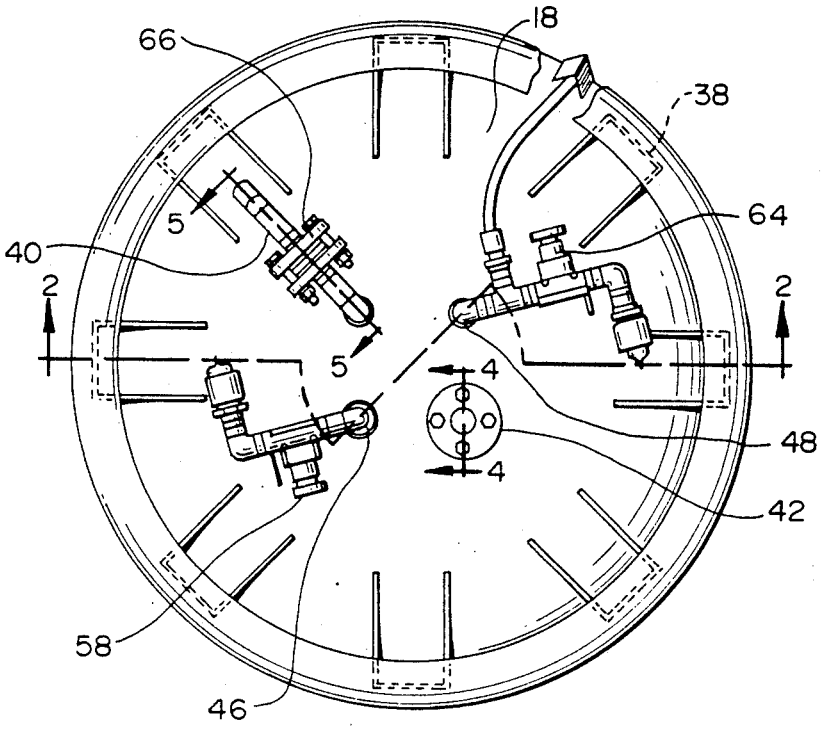
FIG. 1 is a top plan view of the Seamless Pressure Vessel of the present invention in assembly.
Figure 4:
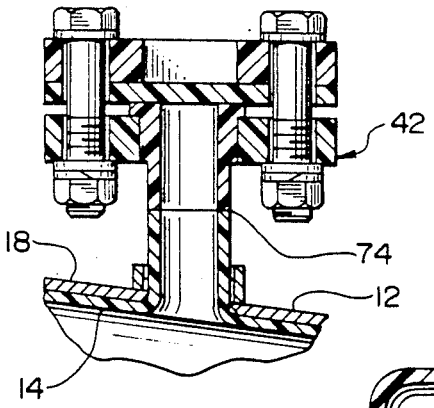
FIG. 4 is an enlarged fragmentary section taken along line 4—4 in FIG. 1.
Figure 5:
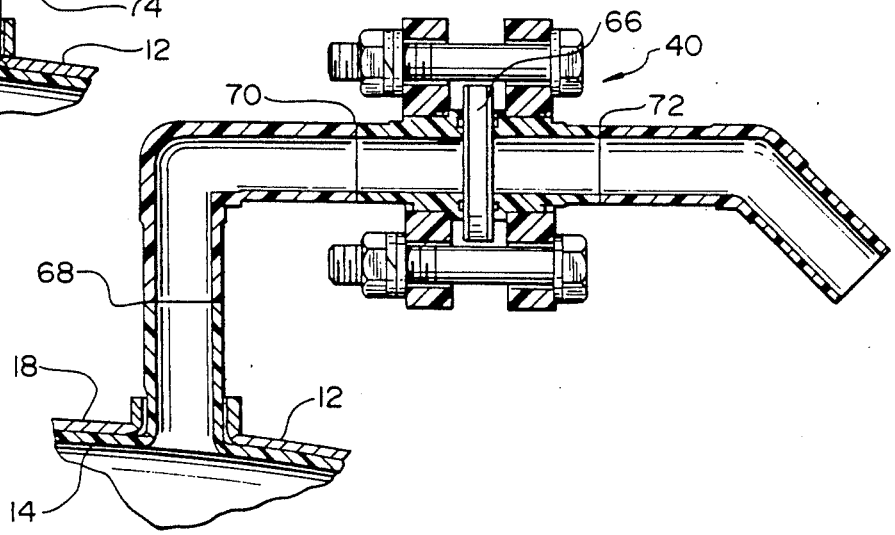
FIG. 5 is an enlarged fragmentary section taken along line 5—5 in FIG. 1.

As illustrated in FIGS. 2, 4 and 5, the inner liner 14 is formed with appropriate fluid flow fittings 40, 42, 44, 46 and 48 extending through correspondingly sized openings in the outer overpack surface to provide access to the vessel interior for pressurized filling and dispensing of fluid contents. Bottom outlet 44 allows for complete drainage of contained fluid product when dispensing through the bottom as well as during cleaning of the vessel. Bottom outlet 44 also allows a tie-in for visual sight tube 50. Sight tube 50 is connected to to pressure port 48 on the upper domed end 18 of the metallic overpack 12 and will display the liquid level within the inner liner 14 of the vessel 10. The connection 52 at the end of bottom outlet 44 is preferably a Flaretek® non-threaded connection. Flaretek® is a trademark of Fluoroware of Chaska, Minn. for their non-threaded connections, designed to be connected/disconnected repeatedly without leakage. Alternatively, any suitable fluid connection means may be used. A ¼ turn, fully open to fully closed, valve 54 is upstream of bottom outlet connection 52. Bottom outlet 44, bottom outlet connection 52 and valve 54 are fully protected by the metallic overpack 12 and are accessible only through a metallic door 56 at the bottom of the circular footed base 36 of the vessel 10.

Top dispense port 46 is used for dispensing of fluid chemical contents when pressurized. Dispense port 46 consists of a valve 58 (accessible on the outside of the overpack 12) connected to a PFA ® pipe 60 that protrudes into the interior of the liner 14 and extends to the bottom center of the vessel 10, at which point it locates in the bottom sump/drain 62. Sump/drain 62 area allows for complete drainage of the fluid chemical contents and also serves as a locator preventing movement of the pipe 60 during transportation.

Top pressure port 48 has two functions. Port 48 is in fluid flow communication with sight tube 50, as previously described. Port 48 also allows for an easy connection to the top valve 64 via a Flaretek ® non-threaded connection, as previously described in regard to 52, for providing an inert gas pressure blanket, usually nitrogen. This pressurized blanket forces the liquid chemical down within the vessel 10 and up through pipe 60 to dispense port 46. This arrangement allows a smooth flow of chemical. The fluid delivery insert assembly may, alternatively, be of any standard design and construction adapted for use with a pressurizable fluid container.

Overpressure release port 40 ends at the upper domed end 18 of the vessel 10 and functions as a safety relief. Within the flanged portion of port 40 is a rupture disk 66 designed to relieve pressure within inner liner 14 if it exceeds a predetermined value, usually 90 psig. This type of release has been incorporated into the vessel 10 in case the pressure regulator malfunctions and allows pressure to build to an unsafe level. If this should occur, rupture disk 66 will burst allowing the inert gas to vent to the atmosphere until a state of equilibrium is attained.

Spare port 42 is an alternative port that can be used for connecting two or more vessels 10 in series or used as an alternate port for filling.

Preferably, connections to these fittings 40, 42, 44, 46 and 48 are completed using a welding process described in co-pending commonly assigned allowed U.S. patent application Ser. No. 881,969, filed July 3, 1986, by Michael L. Osgar, entitled WELDING FLUOROPOLYMER PIPE AND FITTINGS. The Osgar application describes a method of producing butt welds between pipes or ducts of fluoropolymers, such that the welds are extremely chemically inert and which have continuous service temperatures in the ranges of 300° to 500° F. or more, by simultaneously applying infrared or radiant heat to the ends of the pipes or fittings to be welded but without touching the ends being radiated. The radiant heat is derived from a flat faced electric quartz infrared heater which has a surface temperature in excess of 1600° F. and which is maintained for fifteen to forty five seconds at a spacing of approximately 0.25 to 0.50 inch from the end face of the duct. The time of irradiation varies with the size of the pipe being welded and the heater-to-pipe spacing may vary widely, from 0.125 inch to as much as 2.0 inches. The disclosure of this application is specifically incorporated herein by reference. It will however be recognized by those of skill in this art that any suitable method of connecting fittings may be used, if desired.

FIG. 5 illustrates over pressure release 40, showing butt welding joints 68, 70, 72 to fluid fitting 40, according to the process described in Ser. No. 881,969, as referred to above. FIG. 4 illustrates spare port 42 with butt weld joint 74. FIG. 2 illustrates top dispense port 46 with butt weld joint 76 and top pressure port 48 with butt weld joint 78. It is of course obvious to those of skill in this art, that the specific number and purpose of fittings will vary with the specific applications for the present novel Seamless Pressure Vessel and that the particular fittings shown here are representative and for illustrative purposes only.

The complete Seamless Pressure Vessel assembly may be formed of any desirable size, with vessels having a capacity of between about 30 to about 350 gallons of fluid being advantageous for general commercial use. Since the seamless, permanently encapsulated design of the present Seamless Pressure Vessel eliminates the need for periodic disassembly for inspection, it is most advantageously formed in larger sizes of approximately 200 or 330 gallon capacity. The present vessel assembly is designed to withstand pressures for fluid delivery of up to about 60 psi. The inner liner 14 is formed of seamless construction throughout to provide easy and complete drainability, to prevent undesirable retention of the fluid contents during cleaning procedures, and to eliminate any non-uniform obstructing areas that may unwantingly entrap particles or contamination that may adversely effect the purity of the chemical contents. PFA Teflon ® is currently regarded as the best material to use for the liner in the present novel Seamless Pressure Vessel to insure chemical purity to the levels the semiconductor industry requires. It is also compatible with the widest range of chemicals. Another advantage of using PFA Teflon ® for the present novel Seamless Pressure Vessel is its physical flexibility. As the vessel is cycled with pressure, the PFA ® expands and contracts with the cycles without causing stress-induced failures. The thickness tolerance currently provided for the liner as it is molded is 0.120" nominal, 0.060" minimum and 0.180" maximum. The liner is designed to allow only a minimum of gap between the liner and the overpack to prevent overstressing of the liner during pressurization.

It is to be further noted, that from the performance testing that has already been conducted on this novel vessel that the overpack provides ample structural strength and integrity, and that a shock-insulating barrier is not needed. Currently, the stainless steel overpack is formed with a minimum thickness of 0.104" and will withstand a drop test of 75" full of liquid and conditioned to 0° F. Due to the corrosive nature of the chemicals to be transported in this vessel, stainless steel, preferably 304 stainless steel, is used for the overpack. When corrosion resistance is not important, cold-rolled steel could also be used.

That which is claimed is:

1. In a pressurizable vessel for fluid chemicals having an inner plastic liner and an outer overpack permanently heat welded in place around the inner liner in spaced relationship therefrom, the improvement comprising providing a recessed indentation in the area immediately behind the formed heat weld and a sacrificial layer of plastic retained within the recessed indentation between the liner and overpack to protect the liner from the heat of weld formation on the overpack and said recessed indentation further provides space for the formed weld preventing deformation of the liner thereby.

2. The improvement of claim 1, wherein the metal overpack is further integrally formed with a flange extending between the overpack and the sacrificial layer to provide further protection of the liner from the heat of weld formation.

3. A pressurizable vessel for fluid chemicals having an inner liner and an outer overpack wherein:

the inner liner is a separately molded seamless fluoropolymer liner permanently encapsulated within the outer overpack; and the outer overpack is a metal overpack permanently heat welded in place around the inner liner in spaced relationship therefrom; and wherein:

the inner liner is formed with a recessed indentation in the area interior to the formed weld of the outer overpack, said recessed indentation retaining a sacrificial layer of fluoropolymer between the liner and overpack to protect the liner from the heat of weld formation on the overpack and said recessed indentation further provides space for the formed weld preventing deformation of the liner thereby.

4. A pressurizable vessel according to claim 3, wherein said sacrificial layer further provides protection of the inner liner in cutting apart the outer overpack of the pressurizable vessel at the formed weld.

5. A pressurizable vessel according to claim 3, wherein the inner liner is perfluoroalkoxy fluoropolymer.

6. A pressurizable vessel according to claim 3, wherein the outer overpack is stainless steel.

7. A pressurizable vessel according to claim 3, wherein the vessel has a 200 gallon capacity.

8. The pressurizable vessel according to claim 3, wherein the inner liner is formed by rotational molding.

9. A pressurizable vessel according to claim 3, wherein the inner liner is formed by blow molding.

10. A pressurizable vessel according to claim 3, wherein the inner liner is integrally formed with pressurizable fluid flow fittings extending through correspondingly sized openings in the outer overpack surface.

11. A pressurizable vessel according to claim 3, wherein the metal overpack is further formed with a flange positioned between the overpack and the sacrificial fluoropolymer layer to provide further protection of the liner from the heat of welding.

12. A method of forming a pressurizable fluid chemical vessel having an inner fluoropolymer liner permanently encapsulated within an outer metal overpack comprising:

molding a seamless fluoropolymer liner formed with recessed indentation in an area of a weld to be formed on the outer overpack;

providing a sacrificial layer of fluoropolymer within said recessed indentation;

positioning components of the outer metal overpack around the liner, such that assembly joints between the overpack components are positioned over the recessed indentations on the liner with the sacrificial layer of fluoropolymer positioned between the liner indentation and the overpack joint;

heat welding the overpack joints to permanently encapsulate the liner within the overpack, such that the sacrificial layer of fluoropolymer protects the liner from the heat of weld formation on the overpack and the recessed indentation in the liner further provides space for the formed weld preventing deformation of the liner thereby.

13. The method of claim 12, additionally comprising cutting apart the outer overpack of the pressurizable vessel at the formed weld, such that said sacrificial layer further provides protection of the inner liner from said cutting.

14. The method of claim 12, wherein the inner liner is perfluoroalkoxy fluoropolymer.

15. The method of claim 12, wherein the outer overpack is stainless steel.

16. The method of claim 12, wherein the vessel has a 200 gallon capacity.

17. The method of claim 12, wherein the inner liner is formed by rotational molding.

18. The method of claim 12, wherein the inner liner is formed by blow molding.

19. The method of claim 12, wherein the inner liner is integrally formed with pressurizable fluid flow fittings extending through correspondingly sized openings in the outer overpack.

20. The method of claim 12, wherein the metal overpack is further formed with a flange positioned between the overpack and the sacrificial fluoropolymer layer to provide further protection of the liner from the heat of welding.

* * * * *